US005242758A

United States Patent [19]

Hitchcock et al.

[11] Patent Number: 5,242,758

[45] Date of Patent: Sep. 7, 1993

[54] GEAR

[75] Inventors: Keith N. Hitchcock, Tettenhall; Geoffrey R. Armstrong, Newport; Bernard A. Rickinson, Bakewell, all of England

[73] Assignee: Lucas Industries PLC, Solihull, England

[21] Appl. No.: 727,082

[22] Filed: Jul. 9, 1991

[30] Foreign Application Priority Data

Jul. 12, 1990 [GB] United Kingdom ..... 9015381

[51] Int. Cl.[5] ..... B22F 3/00; C22C 28/00

[52] U.S. Cl. ..... 428/547; 428/551; 75/243; 75/244; 75/246; 420/436; 420/440

[58] Field of Search ..... 420/436, 440; 75/243, 75/244, 246; 419/6, 11, 49; 428/547, 551

[56] References Cited

U.S. PATENT DOCUMENTS

| | | | |
|---|---|---|---|
| 2,652,520 | 9/1953 | Studders | 75/243 |
| 3,795,430 | 3/1974 | Farley | 384/625 |
| 3,992,202 | 11/1976 | Dulis et al. | 75/222 |
| 4,473,402 | 9/1984 | Ray et al. | 75/246 |
| 4,729,789 | 3/1988 | Ide et al. | 75/244 |

FOREIGN PATENT DOCUMENTS

| | | | |
|---|---|---|---|
| 0384629 | 8/1990 | European Pat. Off. | 20/00 |
| 2159746 | 6/1973 | France | 1/00 |
| 2271300 | 12/1975 | France | 19/5 |
| 1511734 | 5/1975 | United Kingdom | 19/8 |
| 2220595 | 1/1990 | United Kingdom | 15/00 |

OTHER PUBLICATIONS

Leone, Frank D., "P/M Parts for Business Machines", pp. 667–670 (publication unknown, date unknown).

Nissel, Ch., "HIP Diffusion Bonding", *Powder Metallurgy International,* vol. 16, No. 3, pp. 113–116, 1984.

"Stellite HS6" (product brochure, best copy available), 3 pp., p. 1 cover, p. 2 properties/applications, p. 3 comparative physical properties (graphs).

World Intellectual Property Organization, International Publication No.: WO 87/06863; International Publication Date: Nov. 19, 1987; Inventors: Turney et al.; Title: "Method of Making Multi-chain Sprockets".

Japanese Patent Abstract, Japanese Patent Application No. JP 84-124738, filed Jun. 18, 1984, to Sugisawa et al., "Abrasion-resistant Sintered Alloys for Hot Tools". This reference may also be found in Chemical Abstracts, Abstract No. 154073D, vol. 104, No. 18, Jan. 6, 1986, Columbus, Ohio.

Japanese Patent Abstract, Japanese Patent Application No. JP 87-14820, filed Jan. 23, 1987, to Takigawa, "Composite Rolls for Heat-resistant Glass"; may also be found in Chemical Abstracts, Abstract No. 42860A, vol. 110, No. 6, Jan. 2, 1989, Columbus, Ohio.

*Primary Examiner*—Peter A. Nelson
*Assistant Examiner*—Ngoclan Mai
*Attorney, Agent, or Firm*—Trexler, Bushnell, Giangiorgi & Blackstone, Ltd.

[57] ABSTRACT

A gear having good fatigue strength and corrosion resistance has a body with gear teeth formed of a hot isostatically pressed alloy powder. The alloy is cobalt based and consists of 10 to 35 wt % Cr, 0–22 wt % Ni, 0–20 wt % W, 0–20 wt % Fe, 0–10 wt % V, 0–10 wt % Mo, 0–6 wt % Nb, 0–3 wt % Si, 0–3 wt % C, 0–3 wt % B and 0–1 wt % Mn, the balance, apart from impurities, being cobalt.

6 Claims, 1 Drawing Sheet

GEAR

This invention relates to a gear, and is more particularly concerned with an internal gear for use in applications where corrosion of the gear teeth present a problem. Such a problem is encountered with gears used in rotary actuators, particularly aircraft actuators, and more particularly actuators of the geared hinge type which are used for operating the leading edge flying control surfaces on certain types of aircraft In EP-A-0384629 published on 9 Aug. 1990, there is described an article which is intended to engage against another article with relative movement therebetween, the article comprising a body having a surface region which (a) engages with said another in use and (b) is defined at least partly by a cladding, said cladding being connected to the material of the body by diffusion bonding and being harder than the material of the body. In one embodiment, the body is formed of tough, high tensile iron or steel, e.g. precipitation-hardened stainless steel and the cladding is formed of a harder material such as hard stainless tool steel or a hard non-ferrous alloy, e.g. a cobalt-based alloy such as is sold under the trade mark Stellite.

In the above-mentioned EP-A-0384629, the article may be a gear having gear teeth on an external or an internal surface region of the gear body.

It is an object of the present invention to provide a gear having teeth which not only possess the required fatigue resistance but also possess a high corrosion resistance.

According to one aspect of the present invention, there is provided a gear comprising a body having gear teeth, characterized in that the gear teeth are formed of a cobalt-based alloy which has been hot isostatically pressed from a powder and which consists of 10 to 35 wt % chromium, 0–22 wt % nickel, 0–20 wt % tungsten, 0–20 wt % iron, 0–10 wt % vanadium, 0–10 wt % molybdenum, 0–6 wt % niobium, 0–3 wt % silicon, 0–3 wt % carbon, 0–3 wt % boron, 0–1 wt % manganese, the balance, apart from impurities, being cobalt.

Preferably, the cobalt-based alloy consists of 26–29 wt % chromium, 5–9 wt % tungsten, 1–1.8 wt % carbon and 0–6 wt % niobium, the balance, apart from impurities, being cobalt.

One preferred embodiment of the alloy consists of 26 wt % chromium, 5 wt % tungsten, 1 wt % carbon and 6 wt % niobium, the balance, apart from impurities, being cobalt.

Another embodiment of the alloy consists of 29 wt % chromium, 9 wt % tungsten and 1.8 wt % carbon, the balance, apart from impurities, being cobalt.

In one embodiment, the body is formed integrally with the gear teeth out of the same alloy in the same hot isostatic pressing operation.

In another embodiment, the body is formed of a suitably corrosion-resistant material, e.g. stainless steel, particularly precipitation-hardened stainless steel. The gear teeth are preferably diffusion bonded to the body. Diffusion bonding may be effected by means of a hot isostatic pressing operation in which the gear teeth are formed from the powdered alloy, or the gear teeth may be provided on a ring of hot isostatically pressed alloy powder which is subsequently diffusion bonded to the body of the gear preferably by means of a hot isostatic pressing operation.

The alloy used is most preferably an alloy of the type which is sold under the trade mark Stellite, e.g. Stellite 6. The powered alloy is typically produced from the melted alloy by an atomisation process.

The use of such materials to produce gear teeth is particularly surprising since the microstructure of a compact material formed from the alloy powder by conventional sintering does not indicate that such material would be suitable for use as a gear material in a highly stressed application. By "conventional sintering" is meant pressing the powder in a die set at 500–1000 MPa to form a "green" preform, and then heating the green preform at 1000°–2000° C. for up to several hours.

It has been discovered that the hot isostatic pressing operation on the alloy powder produces a material which has an unexpectedly good fatigue strength, making it particularly suitable to withstand the rigorous conditions which exist in service of a highly loaded gear for an aircraft application where the weight and size are critical and stress is therefore relatively high.

By the term "hot isostatic pressing" is meant a process which involves the simultaneous application of heat and pressure by means of a gaseous medium (usually argon) to the material being hot isostatically pressed. The hot isostatic pressing operation is usually effected at a pressure of greater than 50 MPa, more usually greater than 100 MPa, and typically at a pressure of about 200–300 MPa at a temperature in the range of approximately 900°–1100° C. for a period of about 1 to 8 hours, typically of the order of 4 hours. The application of heat and pressure simultaneously in the hot isostatic powder pressing process eliminates all porosity from the resulting compact material which becomes substantially fully dense. Air contained in the interstices between the particles is compressed and at the high temperature prevailing, its constituents dissolve in the material of the particles. Sequential application of pressure and heat as in conventional powder metallurgy sintering does not achieve this result and porosity is relatively high.

In spite of its high strength properties, the shape which has been prepared by hot isostatically pressing the alloy powder is machinable. Accordingly, it is within the scope of the present invention, not only to form the teeth during a hot isostatic powder pressing operation, but also to use a hot isostatic powder pressing operation to form a blank in which the teeth may be partly formed, and then to subject such blank to a machining operation to produce at least the final form of the teeth.

Most preferably, the particle size of the alloy powder subjected to hot isostatic pressing is such that it passes through a 150 μm sieve.

The present invention is particularly applicable to epicyclic gears such as are used in the previously mentioned powered geared hinge actuators for aircraft leading edge flying control surfaces.

Accordingly, in another aspect of the present invention, there is provided a geared hinged actuator wherein at least one, and preferably all, of the gears are as defined above in the first aspect of the present invention.

The present invention also resides in the use of a hot isostatically pressed alloy powder in the manufacture of gear teeth using an alloy which consists of 10 to 35 wt % chromium, 0–22 wt % nickel, 0–20 wt % tungsten, 0–20 wt % iron, 0–10 wt % vanadium, 0–10 wt % molybdenum, 0–6 wt % niobium, 0–3 wt % silicon, 0–3 wt % carbon, 0–3 wt % boron, 0–1 wt % manganese, the balance, apart from impurities being cobalt.

Preferably, the cobalt-based alloy consists of 26–29 wt % chromium, 5–9 wt % tungsten, 1–1.8 wt % carbon and 0–6 wt % niobium, the balance, apart from impurities, being cobalt.

One preferred embodiment of the alloy consists of 26 wt % chromium, 5 wt % tungsten, 1 wt % carbon and 6 wt % niobium, the balance, apart from impurities, being cobalt.

Another embodiment of the alloy consists of 29 wt % chromium, 9 wt % tungsten and 1.8 wt % carbon, the balance, apart from impurities, being cobalt.

In the production of a gear according to the present invention, any of the following techniques may be employed:

1. Secure a collapsible wall to the gear body so as to define an annular chamber between the wall and a location on the body at which the teeth are to be provided, fill the chamber with the alloy powder, seal the chamber, and perform a hot isostatic pressing operation on the resultant assembly so as to form the teeth by a hot isostatic pressing operation and, simultaneously, secure the teeth to the body by diffusion bonding, remove the wall and cut gear teeth in the resultant hot isostatically pressed alloy material by means of a hobbing or other suitable machining operation.

2. Proceed as for 1 above, but utilise a collapsible wall which is formed integrally with the gear body rather than being secured thereto.

3. Proceed as for 1 or 2 above, but provide the wall with a gear tooth form so that the hot isostatic pressing operation results in the teeth being at least partially formed, and if necessary perform a shaping operation to produce the final tooth form.

4. Fill alloy powder into a space defined between a peripheral surface of a gear body where teeth are to be provided and a ceramic former having a tooth form on a peripheral surface thereof spaced from and facing said peripheral surface of the gear body, evacuate and seal the filled space at each end using collapsible end walls, subject the assembly to hot isostatic pressing, and subsequently remove the end walls and the ceramic core. In the case of an internal gear, said peripheral surface of the gear body is the inner peripheral surface of an annular gear body, whilst said peripheral surface of the ceramic former is the outer peripheral surface of a ceramic core. In the case of an external gear, said peripheral surface of the gear body is the outer peripheral surface of the gear body which may or may not be annular, and said peripheral surface of the ceramic former is the inner peripheral surface of an annular ceramic former which surrounds the gear body. This technique minimises, and may even completely eliminate, the need to machine the final tooth form.

5. Form a tooth ring by hot isostatically pressing the alloy powder in a suitable enclosure, remove the resultant gear ring and secure it to the gear body, e.g. by means of a diffusion bonding process which may be effected in a hot isostatic pressing operation.

6. Produce a green powder preform in the shape of a toothed ring, mount such ring in a chamber defined between a collapsible wall and the body of the gear, and proceed as in 1, 2 or 3 above.

7. Produce a green powder preform, mount it in a suitable recess in the gear body, seal the joint between the powder preform and the body, e.g. by electroplating the assembly, perform a hot isostatic pressing operation on the sealed assembly, remove the seal, and, if necessary, perform a shaping operation to produce the final tooth form.

8. Form a ring or green powder preform, mount it on the gear body, envelope the whole assembly in a container with collapsible walls, effect hot isostatic pressing and, as necessary, machine to the final shape.

9. Form the whole gear including the body in a single stage operation by hot isostatically pressing the alloy powder and, if necessary, performing a shaping operation to produce the final form of the gear teeth.

During the hot isostatic pressing process, it is possible to arrange for part of the material being hot isostatically pressed to flow into or around a recess or projection in or on the gear body in order to provide a mechanical key between the material forming the gear teeth and the body. Such a recess or projection may also assist in locating the material prior to hot isostatic pressing.

In the case of powders, the powder is encapsulated in a collapsible sealed container or can which is removed after completion of hot isostatic pressing. By the term "collapsible" is meant the property of collapsing under the isostatic pressure so that the pressure is supplied to the powder. Evacuation of the container may be effected prior to sealing and hot isostatic pressing.

In the case of hot isostatic pressing of a green powder preform prepared by pressing the powder in a die set, it is also necessary to encapsulate the preform or otherwise seal the surface to prevent the gaseous pressure medium from entering the pores between the particles of the preform. This may be achieved by encapsulation in a collapsible container or electroplating as described above, or by otherwise sealing the surfaces of the preform.

BRIEF DESCRIPTION OF THE DRAWINGS

Embodiments of the present invention will now be described, by way of example, with reference to the accompanying drawing, in which:

Referring now to FIG. 1, a gear body 10 is formed of precipitation-hardened stainless steel according to BSS 143 with an internal bore 12 in which gear teeth are to be provided. Stellite 6 (26 wt % chromium, 5 wt % tungsten, 1 wt % carbon and 6 wt % niobium, the balance apart from impurities being cobalt) in a finely divided form (particle size = −150 μm) is packed into an open-topped annular chamber 14 which is defined between the bore 12 of the gear body 10 and a configurated collapsible annular wall 16 welded at 18 to the wall of the bore 12. The collapsible wall 16 has a toothed peripheral surface 20. The open top of the chamber 14 is then sealed by welding an annular plate 22 to the top of the wall 16 and to the body 10. The resultant assembly is then hot isostatically pressed in a hot isostatic pressing apparatus sold by ASEA Pressure Systems Inc. under a pressure of 100 MPa for 8 hours at a temperature of 1100° C. After such time, the plate and the wall 16 are removed in a machining operation which also serves to produce the final tooth form. The material of the resultant teeth has the following properties:

Corrosion resistance—greater than 500 hours under a salt fog test (MIL standard 810D)

Fatigue strength—$10^6$ cycles (0–690 MPa cyclical test)

Ultimate tensile strength—1150 MPa

Figure 1:
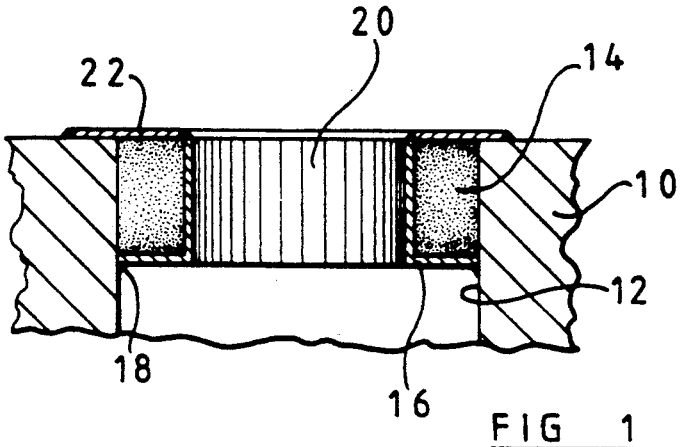
FIG. 1 is a sectional view through a partly formed gear according to one example of the present invention.
Figure 2:
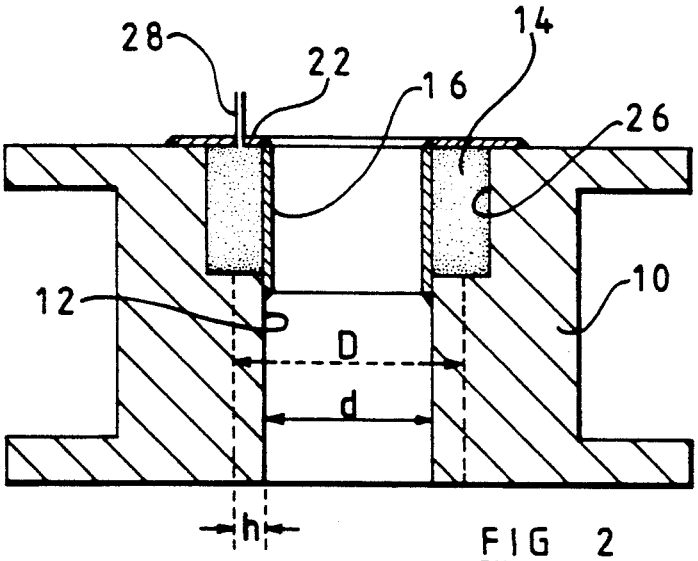
FIG. 2 is a similar view in respect of a second example of gear according to the present invention.

Referring now to FIG. 2 of the drawing, similar parts to the example disclosed above in relation to FIG. 1 are accorded the same reference numerals. In this example, the internal bore 12 of gear body 10 as illustrated in FIG. 2 has a diameter d which is less than the final internal diameter D of the finished gear by an amount corresponding to twice the intended root-to-tip height h of the teeth in the finished gear. However, an annular recess 26 is cut into the internal bore 11 of the body 10 so as to extend axially from one end of the latter for about one-third of the length of the body. Collapsible wall 16 is welded at 18 to the internal bore 11 so as to close the inner periphery of annular recess 26 whereby open-topped annular chamber 14 is defined, into which latter Stellite 6 in a finely divided form is packed. In this embodiment, the annular wall is a simple sleeve having no tooth form thereon. The top of chamber 14 is then closed by annular plate 22 welded to the end of the body 10 and to the wall 16, followed by evacuation of the chamber 14 through vent pipe 28 which is then securely sealed.

The whole assembly is then hot isostatically pressed. Following hot isostatic pressing the wall 16 and plate 22 are machined away, the internal bore 12 is machined to final diameter D and the required tooth form is machined in the hot isostatically pressed Stellite 6 powder.

We claim:

1. A gear comprising a body and gear teeth, said gear teeth being formed of a cobalt-based alloy which has been hot isostatically pressed from a powder for providing high fatigue strength and high corrosion resistance, said cobalt alloy consisting essentially of 10–35 wt % chromium, 0–22 wt % nickel, 0–20 wt % tungsten, 0–20 wt % iron, 0–10 wt % vanadium, 0–10 wt % molybdenum, 0–6 wt % niobium, 0–3 wt % silicon, 0–3 wt % carbon, 0–3 wt % boron, 0–1 wt % manganese, the balance, apart from impurities, being cobalt.

2. The gear as claimed in claim 1, wherein said cobalt-based alloy consists of 26 wt % chromium, 5 wt % tungsten, 1 wt % carbon and 6 wt % niobium, the balance apart from impurities, being cobalt.

3. The gear as claimed in claim 1, wherein said cobalt-based alloy consists of 29 wt % chromium, 9 wt % tungsten and 1.8 wt % carbon, the balance, apart from impurities, being cobalt.

4. The gear as claimed in claim 1, wherein said body is one which has been formed integrally with said gear teeth out of the same alloy in the same hot isostatic pressing operation.

5. The gear as claimed in claim 1, wherein said body is formed of precipitation-hardened stainless steel and said teeth are formed of the specified cobalt-based alloy, said teeth being joined to said body by means of a diffusion bond.

6. The gear as claimed in claim 1, wherein the particle size of said powder subjected to hot isostatic pressing is such that it passes through a 150 μm sieve.

* * * * *